US010962034B1

(12) United States Patent
Chuan

(10) Patent No.: US 10,962,034 B1
(45) Date of Patent: Mar. 30, 2021

(54) DRIVING PUMP AND CLAMPING TOOL COMPRISING THE SAME

(71) Applicant: KUDOS MECHANICAL CO., LTD., New Taipei (TW)

(72) Inventor: James Chuan, New Taipei (TW)

(73) Assignee: KUDOS MECHANICAL CO., LTD., New Taipei (TW)

( * ) Notice: Subject to any disclaimer, the term of this patent is extended or adjusted under 35 U.S.C. 154(b) by 0 days.

(21) Appl. No.: 16/749,399

(22) Filed: Jan. 22, 2020

(30) Foreign Application Priority Data

Nov. 19, 2019 (TW) ..... 108142014

(51) Int. Cl.
*F15B 15/20* (2006.01)
*F15B 11/08* (2006.01)

(52) U.S. Cl.
CPC ..... *F15B 15/20* (2013.01); *F15B 11/08* (2013.01)

(58) Field of Classification Search
CPC ..... F15B 15/20; F15B 11/08; B25B 5/061; B25B 5/087; B25B 5/122; B25B 7/126
See application file for complete search history.

(56) References Cited

U.S. PATENT DOCUMENTS 3,732,026 A * 5/1973 Peters ..... B23B 31/1207 408/124
5,125,324 A * 6/1992 Araki ..... B25B 27/10 269/238
6,543,223 B2 * 4/2003 Muschong ..... F15B 15/18 60/476
7,111,835 B2 * 9/2006 Nagai ..... B25B 5/061 269/228
8,151,703 B2 * 4/2012 Schweizer ..... H01R 3/0427 100/269.15
8,198,839 B2 * 6/2012 Katou ..... B25F 5/02 318/400.01

* cited by examiner

*Primary Examiner* — Thomas E Lazo
(74) *Attorney, Agent, or Firm* — Rabin & Berdo, P.C.

(57) ABSTRACT

A driving pump has an oil reservoir, a main assembly, a driving assembly, and a piston. The main assembly includes a first chamber, a second chamber, an exhaust channel, and an exhaust blockage. The exhaust channel communicates with the first chamber and the oil reservoir. When the piston is subjected to an outer reaction force and the driving assembly keeps pushing the first chamber, the oil and the gas in the first chamber may flow back to the oil reservoir. A clamping tool has the driving pump for controlling a clamp. Thus, even if the oil reservoir contains gas and the gas flows into the main assembly with the oil, the gas and the oil can be discharged back to the oil reservoir via the exhaust channel.

20 Claims, 14 Drawing Sheets

DRIVING PUMP AND CLAMPING TOOL COMPRISING THE SAME

BACKGROUND OF THE INVENTION

1. Field of the Invention

The present invention relates to a driving pump and an electrical tool, especially to a driving pump for pushing components to move via hydraulic press and an electrical tool comprising said driving pump.

2. Description of the Prior Arts

The conventional driving pump includes an oil reservoir, a driving assembly, and a piston. When the driving assembly is operating, oil in the oil reservoir is drawn out and then pushed into the piston after pressurized, which drives the piston to move. However, during a manufacturing process of the conventional driving pump, even though the oil reservoir may be vacuumed after the oil is filled into the oil reservoir and before the oil reservoir is sealed with the driving assembly, the oil reservoir may still inevitably contain gas therein. If the oil reservoir contains gas, when the driving assembly draws the oil from the oil reservoir, the gas will be drawn out at the same time. However, because the gas is compressible, the driving assembly pressurizes the oil and the gas at the same time, which compresses the volume of the gas, and thereby the amount of the oil flows into the piston is insufficient to push the piston to move. In other words, if the driving assembly contains gas, the driving pump may not work.

To overcome the shortcomings, the present invention provides a driving pump and a clamping tool to mitigate or obviate the aforementioned problems.

SUMMARY OF THE INVENTION

The main objective of the present invention is to provide a driving pump and a clamping tool that can discharge the gas in the supply portion, so the driving pump can push the piston even when the piston is subjected to outer reaction force generated from the clamped object.

The driving pump has an oil reservoir, a main assembly, a driving assembly, a power assembly, and a piston. The main assembly comprises a first major channel, a first inlet blockage, a first outlet blockage, a second major channel, a second inlet blockage, a second outlet blockage, a first chamber, a second chamber, an exhaust channel, and an exhaust blockage. The first major channel comprises a first inlet section, a first manifold section, and a first outlet section. The first inlet section, the first manifold section, and the first outlet section communicate with each other in sequence. The first inlet section also communicates with the oil reservoir. The first inlet blockage is movably mounted in the first major channel and selectively isolates the first inlet section and the first manifold section. The first outlet blockage is movably mounted in the first major channel and selectively isolates the first manifold section and the first outlet section. The second major channel comprises a second inlet section, a second manifold section, and a second outlet section. The second inlet section, the second manifold section, and the second outlet section communicate with each other in sequence. The second inlet section also communicates with the oil reservoir. The second inlet blockage is movably mounted in the second manifold section and selectively isolates the second inlet section and the second manifold section. The second outlet blockage is movably mounted in the second outlet section and selectively isolates the second manifold section and the second outlet section. The first chamber communicates with the first manifold section and the second chamber communicates with the second manifold section. A sectional area of the second chamber is smaller than a sectional area of the first chamber. Two ends of the exhaust channel respectively communicates with the first chamber and the oil reservoir. The exhaust blockage selectively blocks the exhaust channel. The driving assembly comprises a driving rod, a stroke controlling component, a communicating passage, and a communicating blockage. The driving rod is movably mounted through the first chamber and the second chamber and comprises a first end and a second end opposite the first end. The second end of the driving rod is located in the second chamber and sealing the second chamber. The stroke controlling component is mounted on the driving rod securely, located in the first chamber, and seals the first chamber. Two ends of the communicating passage respectively communicate with the first chamber and the second chamber. The communicating blockage selectively blocks the communicating passage. The power assembly is connected to the first end of the driving rod and configured to drive the driving rod. The piston is movably mounted on the main assembly and comprises an oil chamber. The oil chamber communicates with the first outlet section and the second outlet section.

The clamping tool has a housing, an aforementioned driving pump, a first clamping component, and a second clamping component. The driving pump is securely mounted in the housing. The first clamping component is securely mounted on the piston of the driving pump. The second clamping component is securely mounted on the housing. A clamping distance is defined between the first clamping component and the second clamping component and controlled by a position of the piston of the driving pump.

One of the advantages of the present invention is that even if the oil in the oil reservoir contains gas and the oil flows into the main assembly with the gas, the gas may be discharged back to the oil reservoir by the exhaust channel. Therefore, the driving pump can rival the outer reaction force generated from the clamped object and clamp the object tightly.

Other objectives, advantages and novel features of the invention will become more apparent from the following detailed description when taken in conjunction with the accompanying drawings.

BRIEF DESCRIPTION OF THE DRAWINGS

FIG. 3 is another sectional view of the driving pump of the clamping tool in

FIG. 1;

DETAILED DESCRIPTION OF THE PREFERRED EMBODIMENTS

Figure 1:
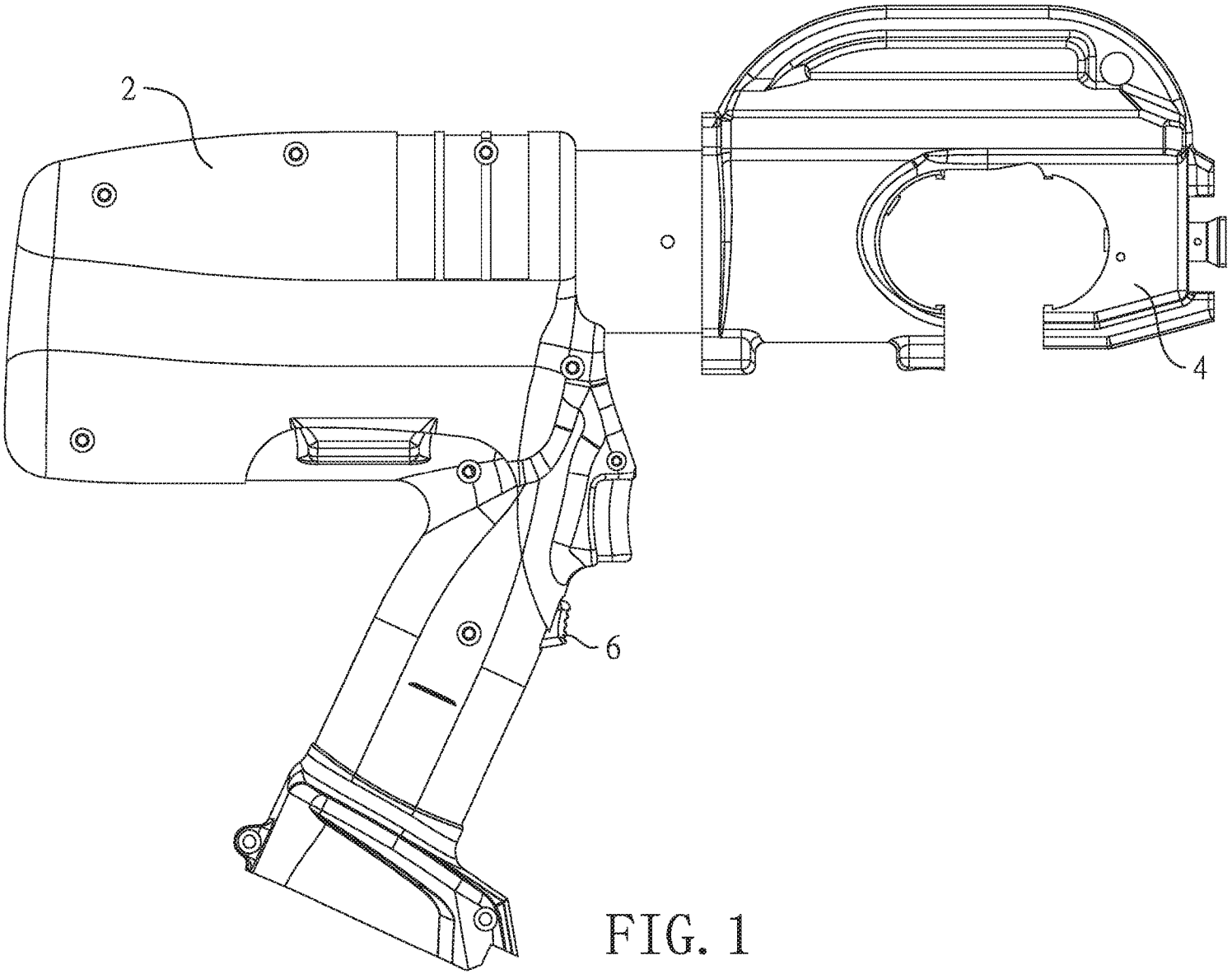
FIG. 1 is a side view of a clamping tool in accordance with the present invention.
Figure 2:
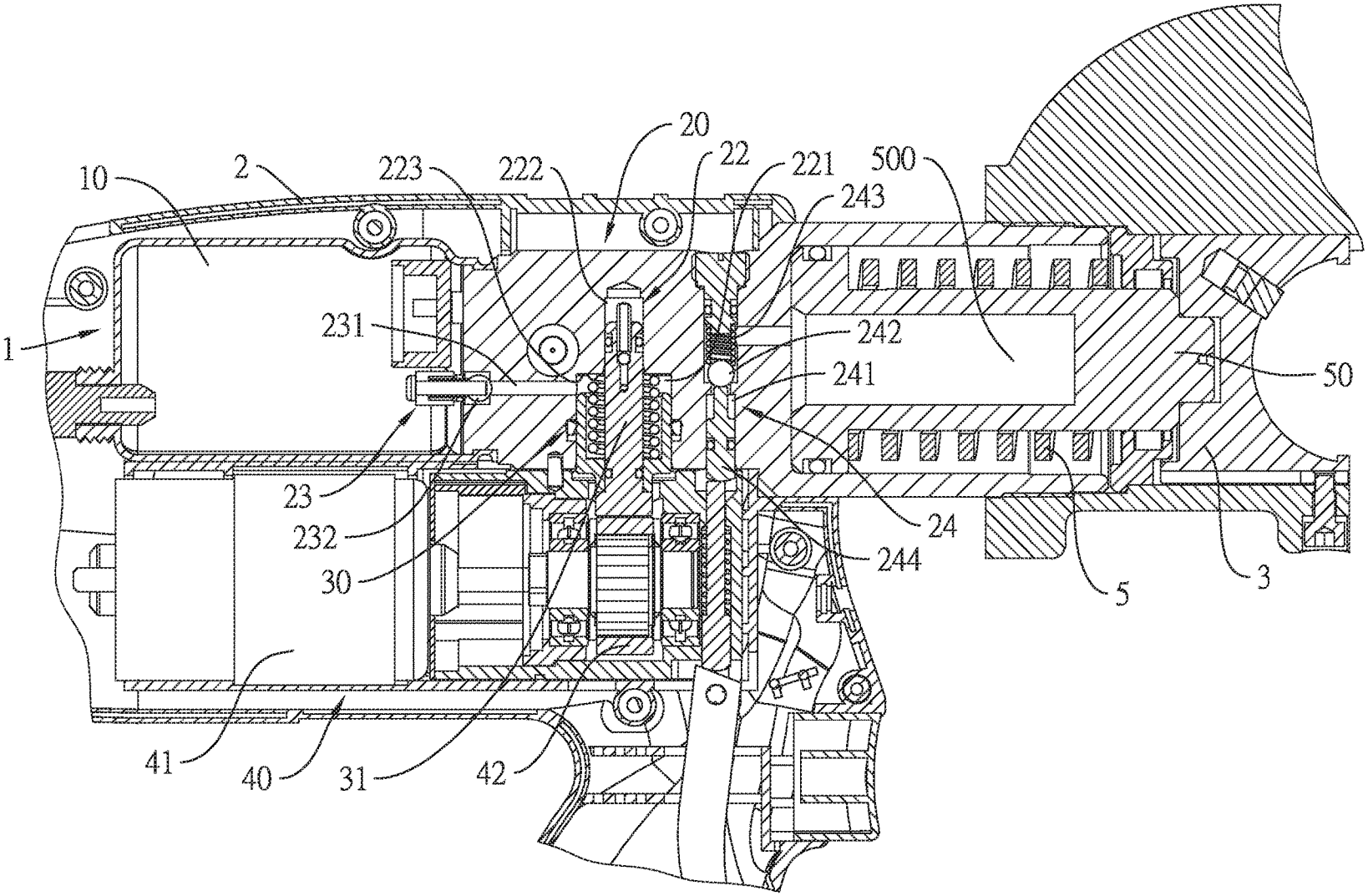
FIG. 2 is a sectional view of a driving pump of the clamping tool in FIG. 1.

With reference to FIG. 1 and FIG. 2, a driving pump 1 and a clamping tool comprising the driving pump 1 in accordance with the present invention are provided. The clamping tool also comprises a housing 2, a first clamping component 3, and a second clamping component 4, and further selectively comprises a reset elastic component 5. The driving pump 1 is securely mounted in the housing 2. The first clamping component 3 is connected to the driving pump 1 and the second clamping component 4 is securely mounted on the housing 2 so that a position of the first clamping component 3 is controlled by the driving pump 1. Therefore, a clamping distance defined between the first clamping component 3 and the second clamping component 4 is controlled by the driving pump 1. In this embodiment, the reset elastic component 5 is connected to the first clamping component 3 and configured to push the first clamping component 3 for increasing the clamping distance. However, in another embodiment, the clamping tool may not comprise the reset elastic component 5 but increase the clamping distance by another method.

Figure 3:
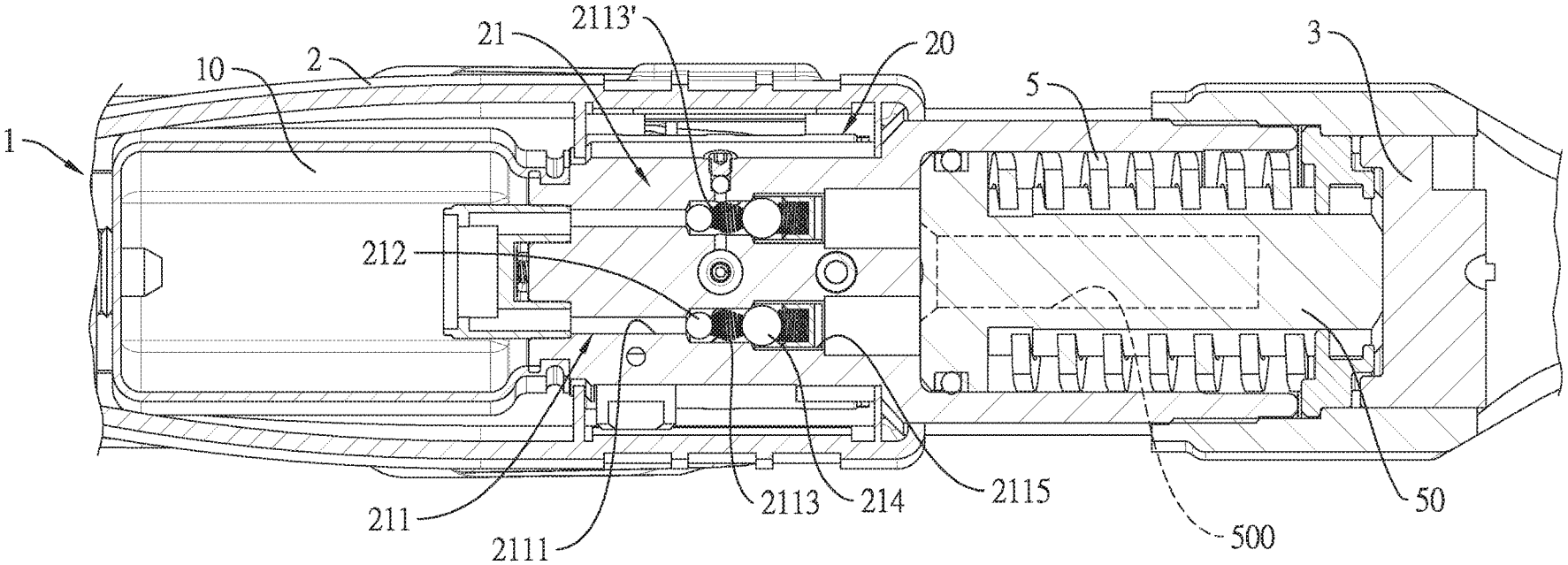

Then please refer to FIG. 2 and FIG. 3. The driving pump 1 comprises an oil reservoir 10, a main assembly 20, a driving assembly 30, a power assembly 40, and a piston 50. The main assembly 20 comprises a supply portion 21, a driving portion 22, and an exhaust portion 23. In this embodiment, the main assembly 20 may further comprise a retract portion 24.

Figure 4:
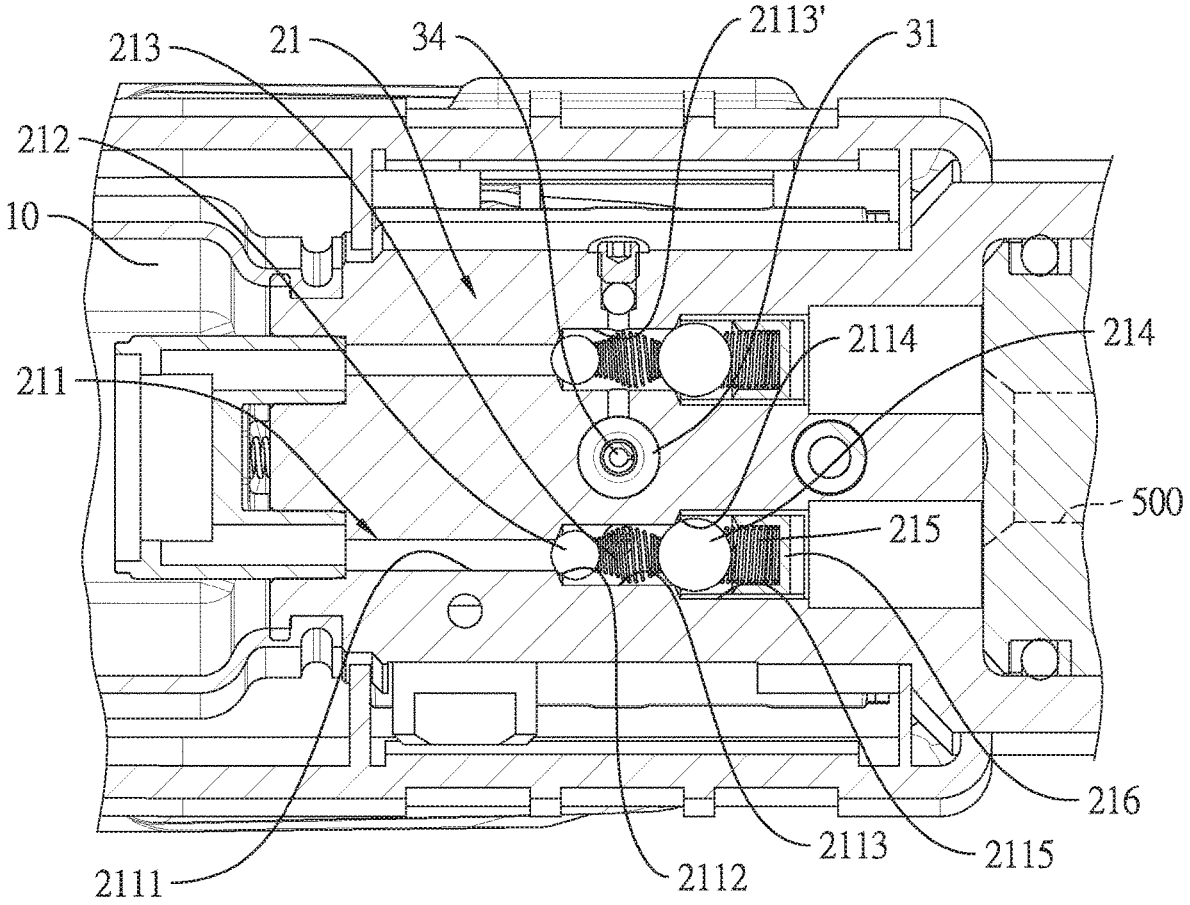
FIG. 4 is an enlarged view of a supply portion of the driving pump in FIG. 3.

Then please refer to FIG. 3 and FIG. 4. The supply portion 21 comprises a first major channel 211, a first inlet blockage 212, and a first outlet blockage 214. In this embodiment, the supply portion 21 may further comprise a first abutted component 216, a first manifold elastic component 213, and a first outlet elastic component 215, but it is not limited thereto. The supply portion 21 may further correspondingly comprise a second major channel, a second inlet blockage, a second outlet blockage, a second abutted component, a second manifold elastic component, and a second outlet elastic component.

Precisely, the first major channel 211 comprises a first inlet section 2111, a first manifold section 2113, and a first outlet section 2115 connecting in sequence. The first inlet section 2111 further communicates with the oil reservoir 10 and the first outlet section 2115 further communicates with the piston 50. In this embodiment, a diameter of the first inlet section 2111 is smaller than that of the first manifold section 2113 and a diameter of the first manifold section 2113 is smaller than that of the first outlet section 2115. In other words, the first major channel 211 forms two stepped surfaces, i.e. a first manifold-abutting surface 2112 and a first outlet-abutting surface 2114. The first manifold-abutting surface 2112 is located between the first inlet section 2111 and the first manifold section 2113 and faces to the first manifold section 2113. The first outlet-abutting surface 2114 is located between the first manifold section 2113 and the first outlet section 2115 and faces to the first outlet section 2115.

The first inlet blockage 212 is movably mounted in the first manifold section 2113 and the first outlet blockage 214 is movably mounted in the first outlet section 2115. The first abutted component 216 is securely mounted in the first outlet section 2115 but does not clog the first outlet section 2115. Corresponding to such structure, the first manifold elastic component 213 is mounted in the first manifold section 2113, and two ends of the first manifold elastic component 213 respectively abut the first inlet blockage 212 and the first outlet blockage 214, which pushes the first inlet blockage 212 to abut the first manifold-abutting surface 2112. Therefore, the first inlet blockage 212 is configured to selectively isolate the first inlet section 2111 and the first manifold section 2113. Similarly, the first outlet elastic component 215 is mounted in the first outlet section 2115, and two ends of the first outlet elastic component 215 respectively abut the first outlet blockage 214 and the first abutted component 216, which pushes the first outlet blockage 214 to abut the first outlet-abutting surface 2114. Therefore, the first outlet blockage 214 is configured to isolate the first manifold section 2113 and the first outlet section 2115.

Similarly, the second major channel comprises a second inlet section, a second manifold section 2113', and a second outlet section connecting in sequence. The second inlet section further communicates with the oil reservoir 10 and the second outlet section further communicates with the piston 50. In this embodiment, a diameter of the second inlet section is smaller than that of the second manifold section 2113' and a diameter of the second manifold section 2113' is smaller than that of the second outlet section. In other words, the second major channel forms two stepped surfaces, i.e. a second manifold-abutting surface and a second outlet-abutting surface. The second manifold-abutting surface is located between the second inlet section and the second manifold section 2113' and faces to the second manifold section 2113'. The second outlet-abutting surface is located between the second manifold section 2113' and the second outlet section and faces to the second outlet section.

The second inlet blockage is movably mounted in the second manifold section 2113' and the second outlet blockage is movably mounted in the second outlet section. The second abutted component is securely mounted in the second outlet section but does not clog the second outlet section. Corresponding to such structure, the second manifold elastic component is mounted in the second manifold section 2113', and two ends of the second manifold elastic component respectively abut the second inlet blockage and the second outlet blockage, which pushes the second inlet blockage to abut the second manifold-abutting surface. Therefore, the second inlet blockage is configured to selectively isolate the second inlet section and the second manifold section 2113'. Similarly, the second outlet elastic component is mounted in the second outlet section, and two ends of the second outlet elastic component respectively abut the second outlet blockage and the second abutted component, which pushes the second outlet blockage to abut the second outlet-abutting surface. Therefore, the second outlet blockage is configured to isolate the second manifold section 2113' and the second outlet section.

However, the structure of the supply portion 21 is not limited to the abovementioned. For example, in another embodiment, the first major channel 211 or the second major channel may be a channel with a uniform diameter, and two rings are mounted in the channel separately. Thus, the two rings form a manifold-abutting surface and an outlet-abutting surface for being abutted by an inlet blockage and an outlet blockage and thereby the channel can be blocked.

The driving portion 22 comprises a first chamber 221 and a second chamber 222. The first chamber 221 communicates with the first manifold section 2113 and the second chamber 222 communicates with second manifold section 2113'. In this embodiment, the first chamber 221 and the second chamber 222 communicate with each other. In this embodiment, a width of the first chamber 221 is larger than that of the second chamber 222 such that the driving portion 22 forms a stepped surface. The stepped surface is defined as a chamber-abutting surface 223. In other words, the chamber-abutting surface 223 is located between the first chamber 221 and the second chamber 222 and faces to the first chamber 221.

Figure 6:
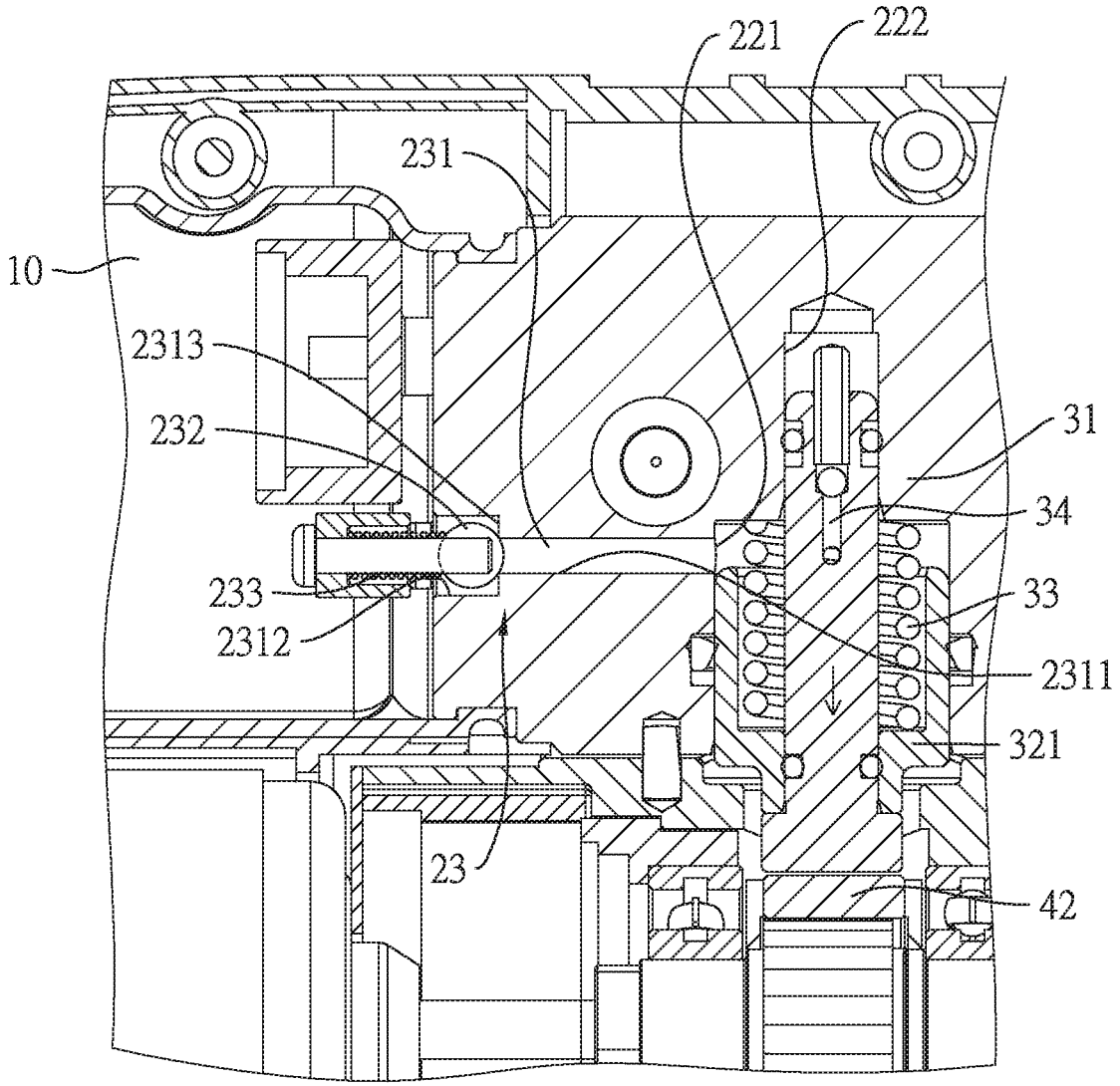
FIG. 6 is another sectional view of the driving assembly and an exhaust portion of the driving pump in FIG. 2.

Then please refer to FIG. 6. The exhaust portion 23 comprises an exhaust channel 231 and an exhaust blockage 232, and in this embodiment further comprises an exhaust elastic component 233. Two ends of the exhaust channel 231 respectively communicate with the first chamber 221 and the oil reservoir 10 and, in this embodiment, the exhaust channel 231 comprises a first exhaust section 2311 and a second exhaust section 2312 communicating with each other. The first exhaust section 2311 further communicates with the first chamber 221 and the second exhaust section 2312 further communicates with the oil reservoir 10. A diameter of the first exhaust section 2311 is smaller than that of the second exhaust section 2312, and thus the exhaust channel 231 forms an exhaust-abutting surface 2313. The exhaust-abutting surface 2313 is located between the first exhaust section 2311 and the second exhaust section 2312 and faces to the second exhaust section 2312.

The exhaust blockage 232 is movably mounted in the second exhaust section 2312 of the exhaust channel 231. The exhaust elastic component 233 is also mounted in the second exhaust section 2312 and can abut the exhaust blockage 232, which pushes the exhaust blockage 232 to abut the exhaust-abutting surface 2313. Therefore, the exhaust blockage 232 can isolate the first exhaust section 2311 and the second exhaust section 2312. In other words, the exhaust blockage 232 selectively blocks the exhaust channel 231.

The retract portion 24 comprises a retract channel 241 and a retract blockage 242 and, in this embodiment, may further comprise a retract elastic component 243. Two ends of the retract channel 241 respectively communicate with the piston 50 and the oil reservoir 10. In this embodiment, the retract channel 241 comprises a first retract section 2411 and a second retract section 2412 communicating with each other. The first retract section 2411 further communicates with an oil chamber 500 of the piston 50 and the second retract section 2412 further communicates with the oil reservoir 10. A diameter of the first retract section 2411 is larger than that of the second retract section 2412, and thus the retract channel 241 forms a retract-section-abutting surface 2413. The retract-section-abutting surface 2413 is located between the first retract section 2411 and the second retract section 2412 and faces to the first retract section 2411

Figure 7:
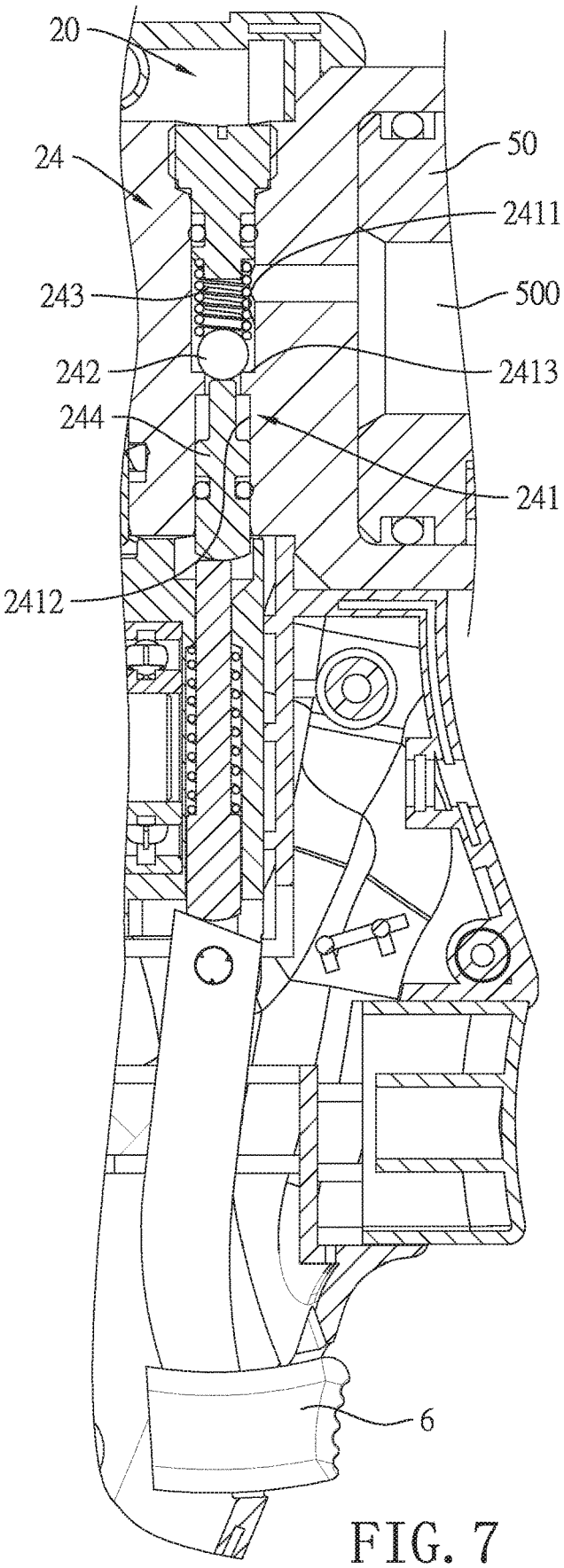
FIG. 7 is a sectional view of a retract portion of the driving pump in FIG. 2.

Then please refer to FIG. 7. The retract blockage 242 is movably mounted in the first retract section 2411. The retract elastic component 243 is also mounted in the first retract section 2411 and can abut the retract blockage 242, which pushes the retract blockage 242 to abut the retract-section-abutting surface 2413. Therefore, the retract blockage 242 can selectively isolate the first retract section 2411 and the second retract section 2412. In other words, the retract blockage 242 selectively blocks the retract channel 241.

In this embodiment, the main assembly 20 further comprises a controlling component 244. The controlling component 244 is mounted in the second retract section 2412, and selectively extends out of the retract-section-abutting surface 2413 and enters the first retract section 2411. Therefore, the controlling component 244 pushes the retract blockage 242 to move and thus the first retract section 2411 and the second retract section 2412 communicate with each other.

The driving assembly 30 comprises a driving rod 31, a stroke controlling component 32, a driving assembly elastic component 33, a communicating passage 34, a communicating blockage 35, and an elastic pin 36.

Figure 5:
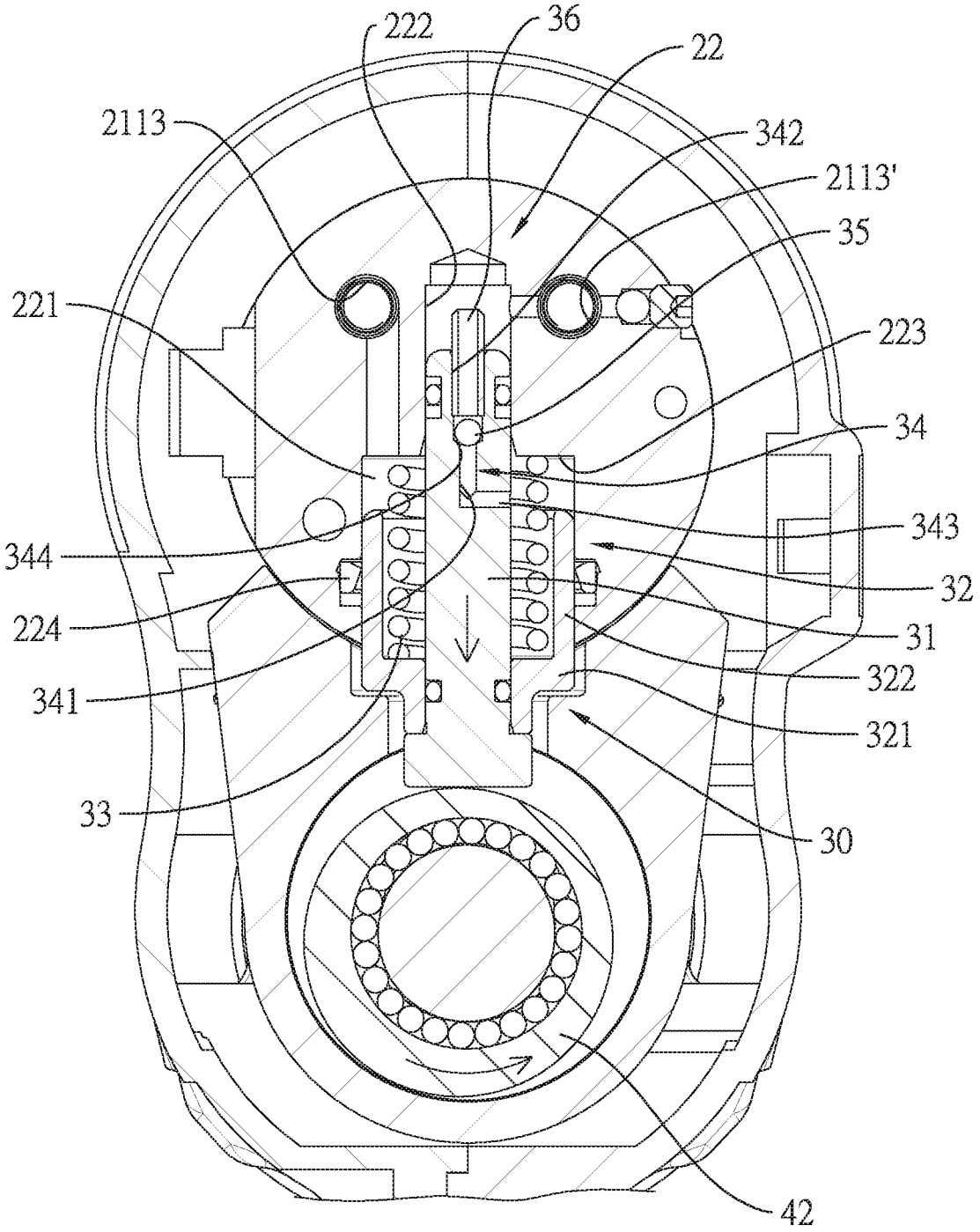
FIG. 5 is a sectional view of a driving portion and a driving assembly of the driving pump in FIG. 2.

Then please refer to FIG. 5. The driving rod 31 is movably mounted through the first chamber 221 and the second chamber 222 and comprises a first end and a second end opposite each other. The second end of the driving rod 31 is located in the second chamber 222 and seals the second chamber 222. Precisely, a diameter of the second end of the driving rod 31 equals to that of the second chamber 222, and the driving rod 31 has a sealing ring mounted thereon for sealing the oil in the second chamber 222. The stroke controlling component 32 is securely mounted between the first end and the second end of the driving rod 31 and located in the first chamber 221. The stroke controlling component 32 seals the first chamber 221. Precisely, a diameter of the stroke controlling component 32 equals to that of the first chamber 221. The driving portion 22 further comprises a sealing component 224. The sealing component 224 is mounted on an inner surface of the first chamber 221 and configured to abut and seal an outer surface of the stroke controlling component 32, which prevents the oil from flowing between the stroke controlling component 32 and the first chamber 221.

In this embodiment, the stroke controlling component 32 comprises a plane portion 321 and a sleeving portion 322. The plane portion 321 is an annular plate and is sleeved on the driving rod 31. The sleeving portion 322 is an annular wall and encompasses the driving rod 31. One end of the sleeving portion 322 is securely mounted on an outer edge of the plane portion 321. Outer diameters of the plane portion 321 and the sleeving portion 322 each equal to a diameter of the first chamber 221, so the sealing component 224 can abut and seal an outer surface of the sleeving portion 322. In this embodiment, the sleeving portion 322 extends toward the second chamber 222 from the plane portion 3210 and encompasses the driving rod 31. In another embodiment, the stroke controlling component 32 may only comprise the plane portion 321 and without the sleeving portion 322.

The driving assembly elastic component 33 is sleeved on the driving rod 31. Two ends of the driving assembly elastic component 33 respectively abut the chamber-abutting surface 223 and the stroke controlling component 32. In this embodiment, the driving assembly elastic component 33 abuts the plane portion 321 of the stroke controlling component 32 and is encompassed by the sleeving portion 322.

The communicating passage 34 comprises a first communicating section 341 and a second communicating section 342 communicating with each other, and selectively further comprises a radial communicating section 343. The first communicating section 341 communicates with the first chamber 221 via the radial communicating section 343. The second communicating section 342 communicates with the second chamber 222. In this embodiment, flow directions of the first communicating section 341 and the second communicating section 342 are parallel to an axial direction of the driving rod 31, and a flow direction of the radial communicating section 343 is parallel to a radial direction of the driving rod 31. A diameter of the first communicating section 341 is smaller than that of the second communicating section 342. In other words, the communicating passage 34 may form a stepped surface, i.e. a communicating-passage-abutting surface 344. The communicating-passage-abutting surface 344 is located between the first communicating section 341 and the second communicating section 342 and faces to the second communicating section 342. The communicating blockage 35 is movably mounted in the second communicating section 342 and selectively abuts the communicating-passage-abutting surface 344 to selectively isolate the first communicating section 341 and the second communicating section 342.

The elastic pin 36 is securely mounted in the second communicating section 342 but protrudes out of the second end of the driving rod 31. In this embodiment, the elastic pin 36 forms a slit. The slit is parallel to the flow direction of the second communicating section 342. With the elastic pin 36, the communicating blockage 35 is restricted in the second communicating section 342.

Then please refer to FIG. 2 and FIG. 5. The power assembly 40 is connected to the first end of the driving rod 31 and thereby drives the driving rod 31 to move. In this embodiment, the power assembly 40 comprises a motor 41 and a cam 42. The motor 41 drives the cam 42 to rotate. The cam 42 abuts the first end of the driving rod 31 and thereby drives the driving rod 31 to move during rotation of the cam 42. However, in another embodiment, the driving rod 31 may be driven by a reciprocating sliding crank mechanism. Thus, the power assembly 40 and the driving assembly 30 control the piston 50 to move forward.

Then please refer to FIG. 3. The piston 50 is movably mounted on the main assembly 20 and comprises the oil chamber 500. The oil chamber 500 communicates with the first inlet section 2111 and the second inlet section. The first clamping component 3 is securely mounted on the piston 50. Thus, a position of the first clamping component 3 is controlled by the piston 50. The second clamping component 4 is securely mounted at the main assembly 20 of the driving pump 1 so the clamping distance between the first clamping component 3 and the second clamping component 4 is controlled by the driving pump 1. In this embodiment, the reset elastic component 5 is connected to the first clamping component 3 and configured to push the clamping component 3 to increase the clamping distance. However, it is not limited thereto, so in another embodiment may extend the clamping distance in other way.

Figure 8:
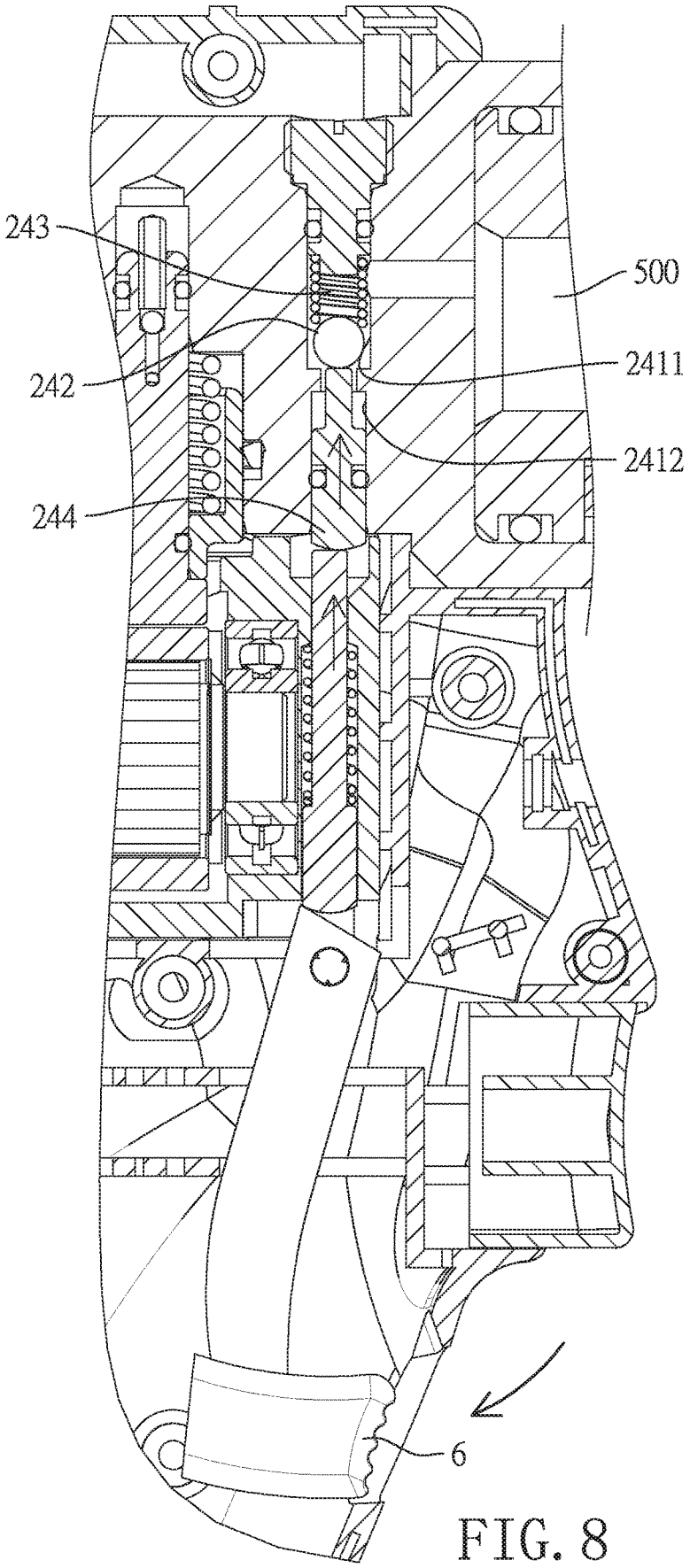
FIG. 8 is another sectional view of the retract portion in FIG. 2, shown after pressed.
Figure 9:
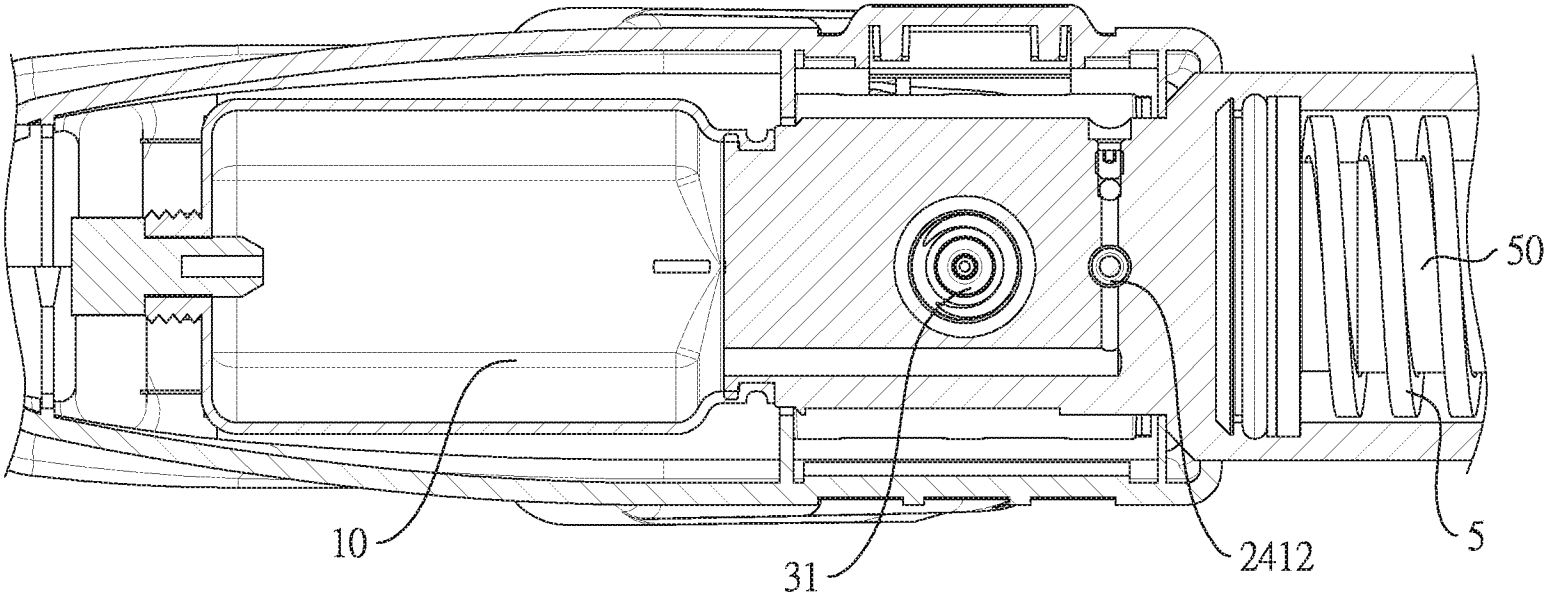
FIG. 9 is another sectional view of the retract portion of the piston pump in FIG. 1.
Figure 10:
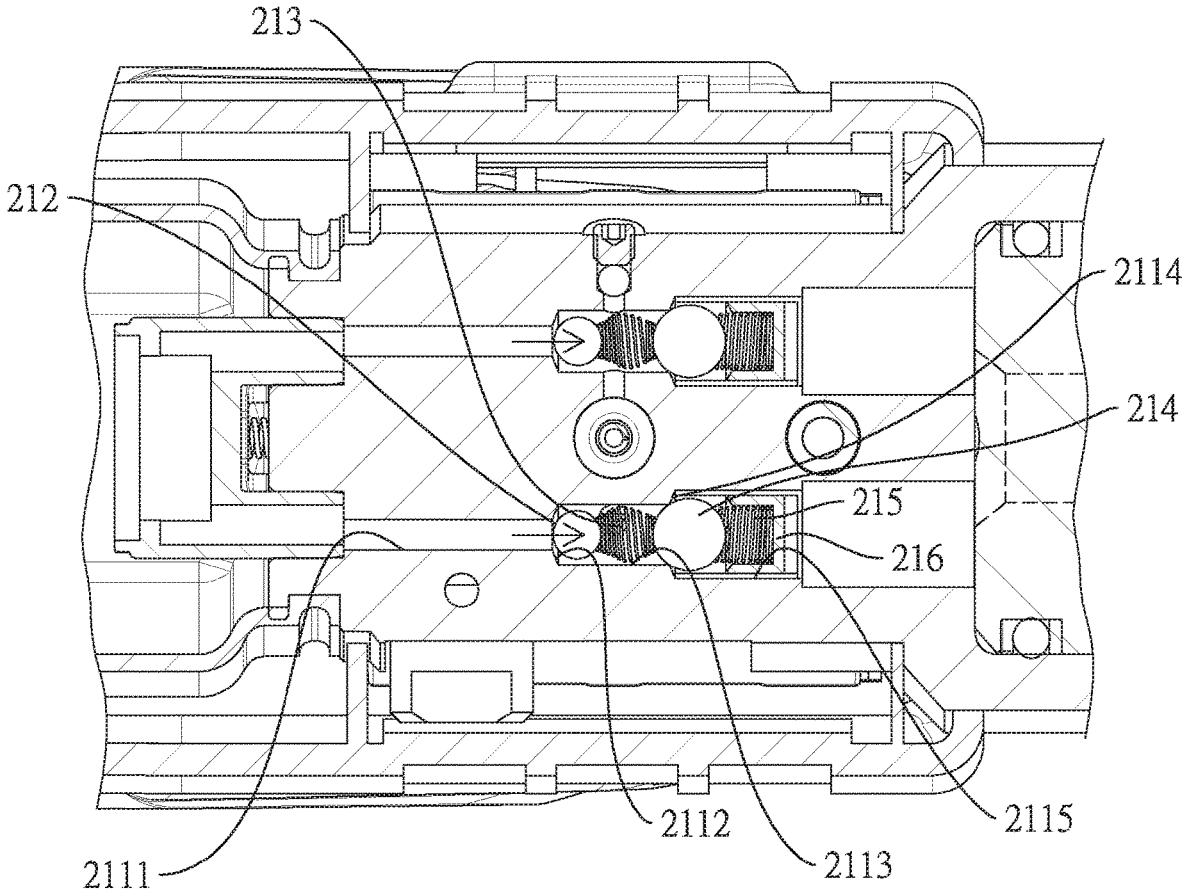
FIG. 10 is an operational view of the supply portion of the driving pump in FIG. 3, showing a driving rod is moving downward.
Figure 11:
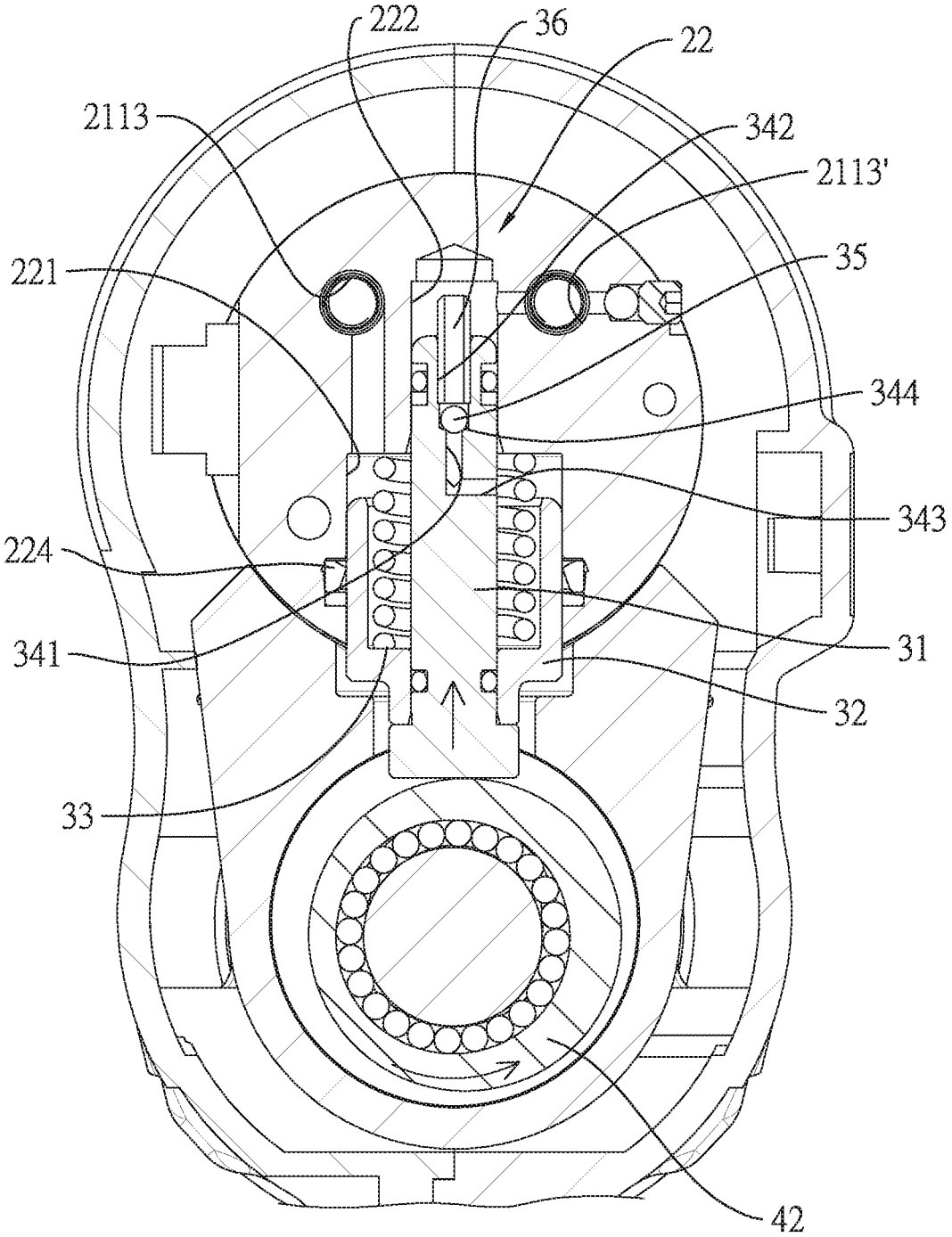
FIG. 11 is an operational view of the driving portion and the driving assembly in FIG. 5, showing the driving rod is moving upward.
Figure 12:
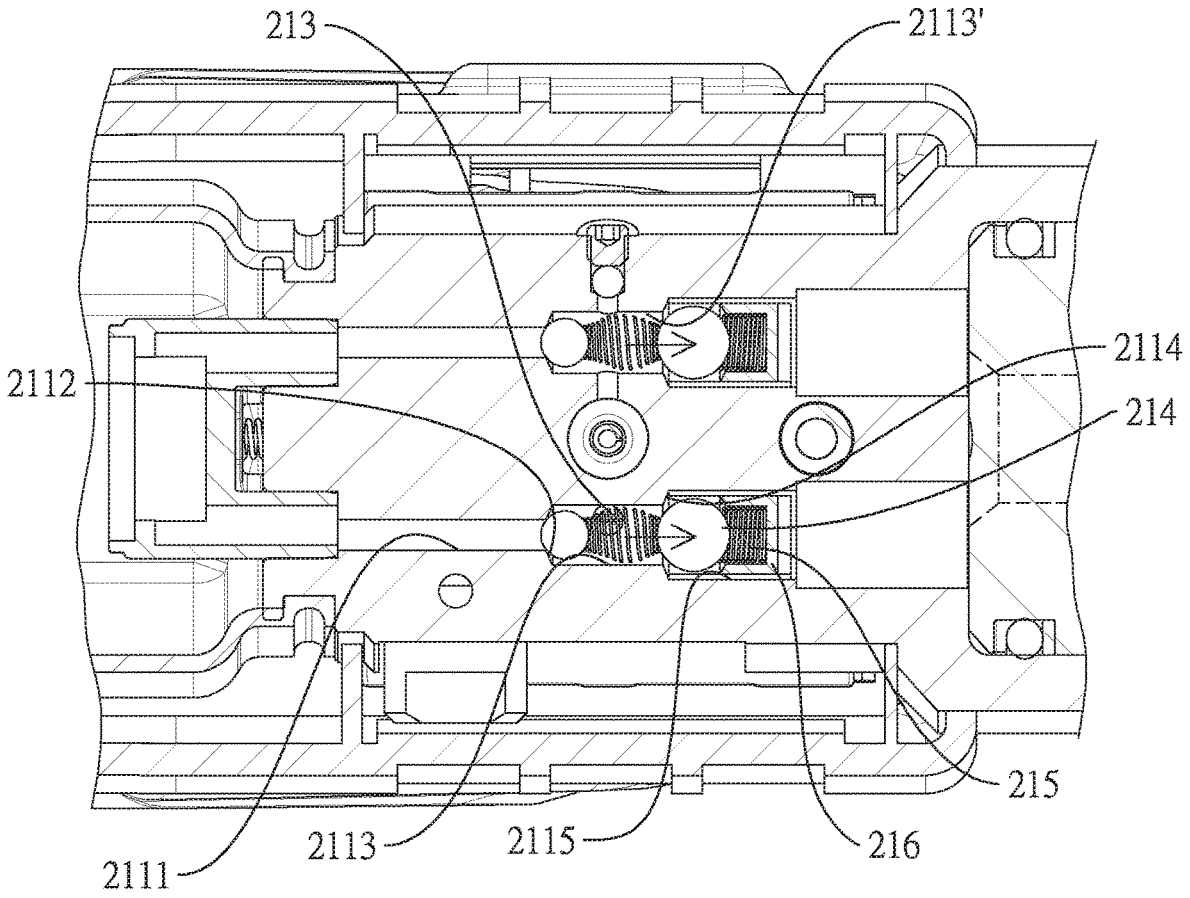
FIG. 12 is another operational view of the supply portion in FIG. 3, showing the driving rod is moving upward.
Figure 13:
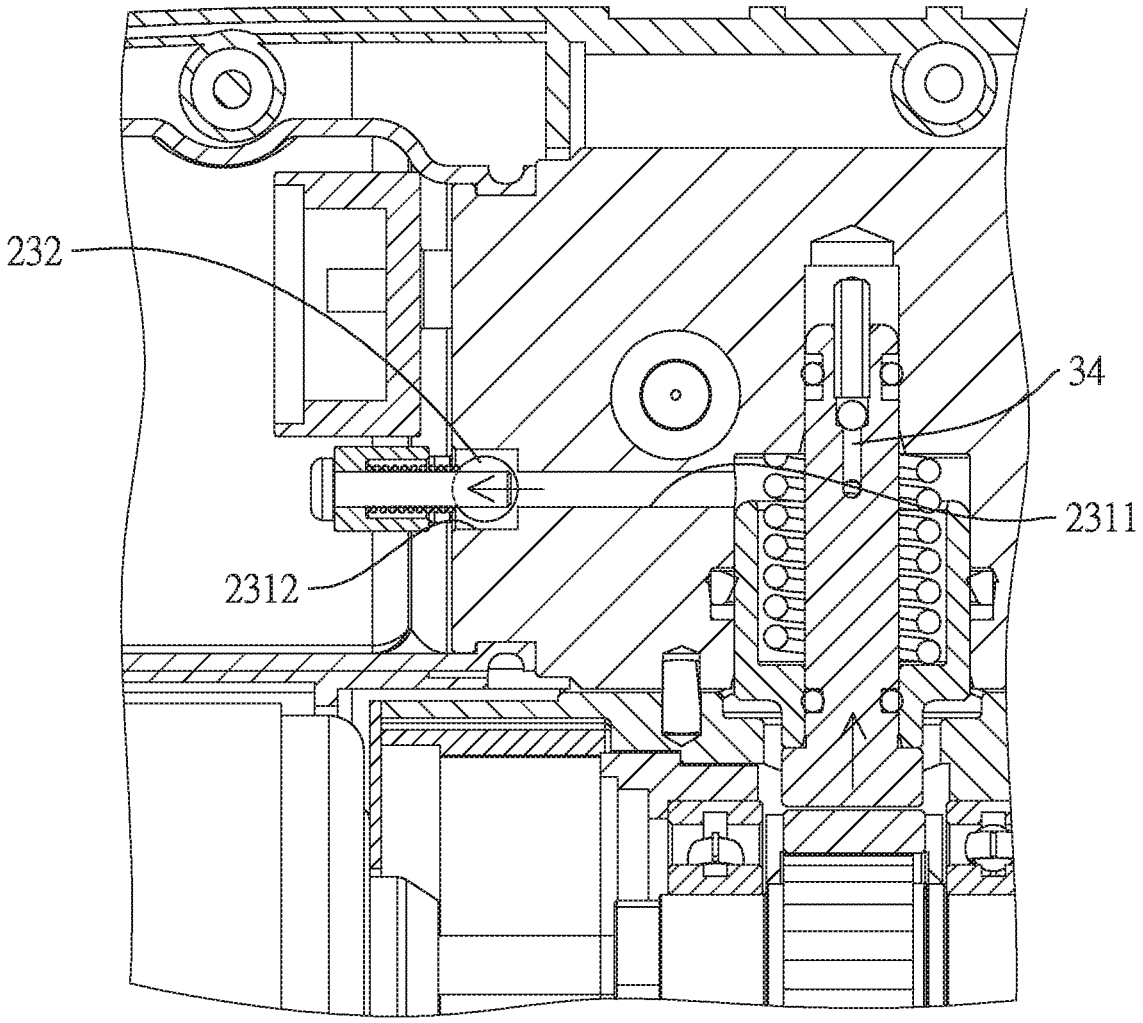
FIG. 13 is an operational view of the driving assembly and the exhaust portion in FIG. 6, showing the driving rod is moving upward.
Figure 14:
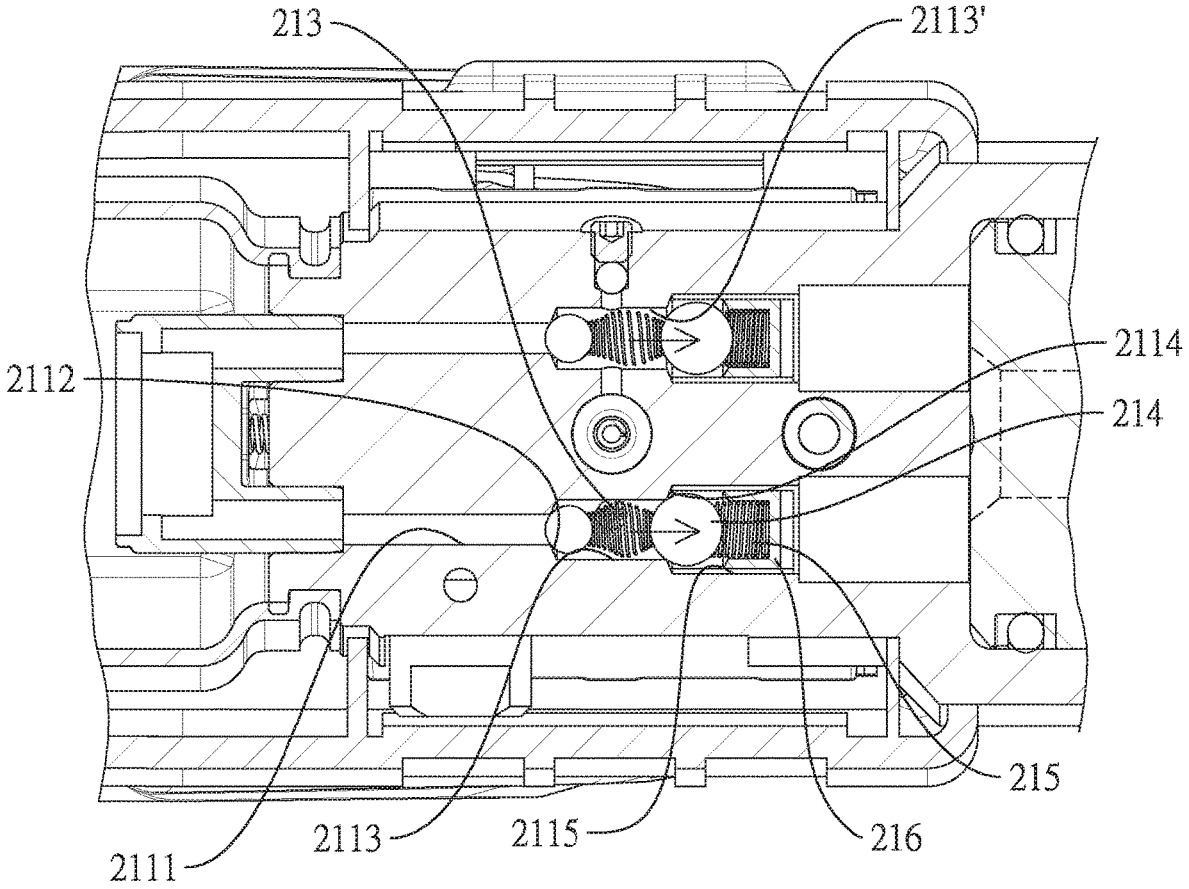
FIG. 14 is an operational view of the supply portion of the driving pump in FIG. 3 under high pressure.

Then please refer to FIG. 7 and FIG. 8. In this embodiment, the clamping tool may further comprise a pressing mechanism 6 mounted on a held portion of the housing 2 and connected to the controlling component 244 of the retract portion 24. Thus, when a user pushes the pressing mechanism 6, the controlling component 244 may push the retract blockage 242 and unblocks the retract channel 241.

Then please refer to FIG. 2, FIG. 4, FIG. 5, and FIG. 9. With aforesaid structures, when the motor 41 drives the cam 42 to rotate, the driving rod 31 will move up and down repeatedly. When the driving rod 31 is moving downward, spaces in the first chamber 221 and the second chamber 222 are enlarged, so pressures in the first manifold section 2113 and the second manifold section 2113' are declined correspondingly. Therefore, the first inlet blockage 212 is separated from the first manifold-abutting surface 2112 and the second inlet blockage is separated from the second manifold-abutting surface, but the first outlet blockage 214 still tightly abuts the first outlet-abutting surface 2114 and the second outlet blockage still tightly abuts the second outlet-abutting surface. In other words, the first inlet section 2111 communicates with the first manifold section 2113 and the second inlet section communicates with the second manifold section 2113' at this time, but the first manifold section 2113 and the first outlet section 2115 are still isolated and the second manifold section 2113' and the second outlet section are still isolated, which only allows oil in the oil reservoir 10 to flow into the first chamber 221 and the second chamber 222. Besides, when the driving rod 31 is moving downward, the pressure in the first chamber 221 is very close to that in the second chamber 222, and thus the oil may not flow between the first chamber 221 and the second chamber 222 via the communicating passage 34.

Then please refer to FIG. 1, FIG. 10, FIG. 11, and FIG. 12. After that, when the driving rod 31 moves upward, the spaces in the first chamber 221 and the second chamber 222 are decreased, so the pressures in the first manifold section 2113 and the second manifold section 2113' are increased correspondingly. Therefore, the first inlet blockage 212 tightly abuts the first manifold-abutting surface 2112 and the second inlet blockage tightly abuts the second manifold-abutting surface, but the first outlet blockage 214 is separated from the first outlet-abutting surface 2114 and the second outlet blockage is separated from the second outlet-abutting surface. In other words, the first inlet section 2111 is isolated from the first manifold section 2113 and the second inlet section is isolated from the second manifold section 2113' at this time, but the first manifold section 2113 communicates with the first outlet section 2115 and the second manifold section 2113' communicates with the second outlet section, which only allows the oil in the first chamber 221 and the second chamber 222 to flow into the oil chamber 500 of the piston 50. The oil flowing into the oil chamber 500 can push the piston 50 to move forward and thus the clamping distance between the first clamping component 3 and the second clamping component 4 is decreased for clamping an object.

At this time, the pressure in the first chamber 221 is not adequate to rival the exhaust elastic component 233, so the exhaust blockage 232 still keeps blocking the exhaust channel 231, which only allows the oil in the first chamber 221 to flow into the oil chamber 500 of the piston 50. With the oil in both of the first chamber 221 and the second chamber 222 flows into the oil chamber 500 of the piston 50, the piston 50 can move at a higher speed to contact and clamp the object.

Then please refer to FIG. 1, FIG. 6, FIG. 13, and FIG. 14. When the first clamping component 3 and the second clamping component 4 clamp the object together, a reaction force may be exerted on the first clamping component 3, which makes the pressure in the oil chamber 500 increase. The pressures in the first chamber 221 and the second chamber 222 increase correspondingly to push the piston 50 to move. However, when the pressure in the first chamber 221 is increased and capable of rivaling the exhaust elastic component 233, the exhaust blockage 232 is pushed away and the first communicating section 341 communicates with the second communicating section 342. At this time, as long as the driving rod 31 moves upward, the oil in the first chamber 221 may flow back to the oil reservoir 10, rather than flow into the oil chamber 500 of the piston 50. Besides, a force of the cam 42 exerted on the driving rod 31 is concentrated on the second end of the driving rod 31, so the pressure in the second chamber 222 can be increased further, and thereby the piston 50 is pushed to clamp the object.

At this time, if the oil contains gas and flows into the second chamber 222, a volume of the gas may be compressed when the pressure in the second chamber 222 is increased. Thus, the decreasing space in the second chamber 222 cannot make the oil flow out of the second chamber 222 so that the piston 50 cannot move forward further. However, in the present invention, with the driving rod 31 moving up and down repeatedly, when the driving rod 31 moves upward again, the oil containing gas in the first chamber 221 may flow back to the oil reservoir 10 via the exhaust channel 231. Therefore, the present invention can prevent the gas accumulated in the second chamber 222 from hindering the piston 50 to be moved.

When the user wants to release the clamped object, the user can press the pressing mechanism 6, and then the controlling component 244 can push the retract blockage 242 and thereby unblock the retract channel 241. Therefore, the oil in the oil chamber 500 of the piston 50 with high pressure may flow back to the oil reservoir 10 via the retract channel 241. In this embodiment, the first clamping component 3 is pushed away from the second clamping component 4 by the reset elastic component 5. Meanwhile, during the driving portion 22 forcing the oil to flow into the oil chamber 500, the air may inevitably flow into the oil chamber 500 with the oil. Therefore, when the user presses the pressing mechanism 6, the air may flow back to the oil reservoir 10 with the oil.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A driving pump comprising:
an oil reservoir;
a main assembly comprising:
a first major channel comprising:
a first inlet section communicating with the oil reservoir,
a first manifold section; and
a first outlet section;
wherein the first inlet section, the first manifold section, and the first outlet section communicate with each other in sequence;
a first inlet blockage movably mounted in the first major channel and selectively isolating the first inlet section and the first manifold section;
a first outlet blockage movably mounted in the first major channel and selectively isolating the first manifold section and the first outlet section;
a second major channel comprising:
a second inlet section communicating with the oil reservoir;
a second manifold section; and
a second outlet section;
wherein the second inlet section, the second manifold section, and the second outlet section communicate with each other in sequence;
a second inlet blockage movably mounted in the second manifold section and selectively isolating the second inlet section and the second manifold section;
a second outlet blockage movably mounted in the second outlet section and selectively isolating the second manifold section and the second outlet section;
a first chamber communicating with the first manifold section;
a second chamber communicating with the second manifold section;
a sectional area of the second chamber smaller than a sectional area of the first chamber;
an exhaust channel; two ends of the exhaust channel respectively communicating with the first chamber and the oil reservoir;
an exhaust blockage selectively blocking the exhaust channel;
a driving assembly comprising:
a driving rod movably mounted through the first chamber and the second chamber and comprising:
a first end; and
a second end opposite the first end, located in the second chamber, and sealing the second chamber;
a stroke controlling component mounted on the driving rod securely, located in the first chamber, and sealing the first chamber;
a communicating passage; two ends of the communicating passage respectively communicating with the first chamber and the second chamber;
a communicating blockage selectively blocking the communicating passage;
a power assembly connected to the first end of the driving rod and configured to drive the driving rod; and
a piston movably mounted on the main assembly and comprising:
an oil chamber communicating with the first outlet section and the second outlet section.

2. The driving pump as claimed in claim 1, wherein:
the first major channel further comprises:
a first manifold-abutting surface located between the first inlet section and the first manifold section and facing to the first manifold section; and
a first outlet-abutting surface located between the first manifold section and the first outlet section and facing to the first outlet section;
the second major channel further comprises:
a second manifold-abutting surface located between the second inlet section and the second manifold section and facing to the second manifold section; and
a second outlet-abutting surface located between the second manifold section and the second outlet section and facing to the second outlet section; and
the main assembly further comprises:
a first manifold elastic component mounted in the first manifold section, configured to push the first inlet blockage to abut the first manifold-abutting surface, and thereby isolating the first inlet section and the first manifold section;
a first outlet elastic component mounted in the first outlet section, configured to push the first outlet blockage to abut the first outlet-abutting surface, and thereby isolating the first manifold section and the first outlet section;

a second manifold elastic component mounted in the second manifold section, configured to push the second inlet blockage to abut the second manifold-abutting surface, and thereby isolating the second inlet section and the second manifold section; and a second outlet-elastic component mounted in the second outlet section, configured to push the second outlet blockage to abut the second outlet-abutting surface, and thereby isolating the second manifold section and the second outlet section.

3. The driving pump as claimed in claim 2, wherein:

the main assembly further comprises:

a first abutted component securely mounted in the first outlet section;

two ends of the first outlet elastic component respectively abutting the first abutted component and the first outlet blockage; and a second abutted component securely mounted in the second outlet section; two ends of the second outlet elastic component respectively abutting the second abutted component and the second outlet blockage;

two ends of the first manifold elastic component respectively abut the first inlet blockage and the first outlet blockage; and two ends of the second manifold elastic component abut the second inlet blockage and the second outlet blockage.

4. The driving pump as claimed in claim 3, wherein:

the main assembly further comprises:

a chamber-abutting surface located between the first chamber and the second chamber and facing to the first chamber;

the driving assembly further comprises:

a driving assembly elastic component sleeved on the driving rod;

two ends of the driving assembly elastic component respectively abutting the chamber-abutting surface and the stroke controlling component; and the power assembly comprises:

a cam abutting the first end of the driving rod such that the driving rod is moved during rotation of the cam.

5. The driving pump as claimed in claim 4, wherein:

the communicating passage comprises:

a first communicating section communicating with the first chamber; and a second communicating section communicating with the first communicating section and the second chamber;

a communicating-passage-abutting surface located between the first communicating section and the second communicating section and facing to the second communicating section; and the communicating blockage movably mounted in the second communicating section and selectively abutting the communicating-passage-abutting surface and thereby isolating the first communicating section and the second communicating section.

6. The driving pump as claimed in claim 5, wherein:

flow directions of the first communicating section and the second communicating section are parallel to an axial direction of the driving rod; and the communicating passage further comprises:

a radial communicating section; a flow direction of the radial communicating section parallel to a radial direction of the driving rod; the first communicating section communicating with the first chamber via the radial communicating section.

7. The driving pump as claimed in claim 6, wherein: the driving assembly further comprises:

an elastic pin securely mounted in the second communicating section and protruding out of the second end of the driving rod.

8. The driving pump as claimed in claim 7, wherein the stroke controlling component comprises:

a plane portion being an annular plate and sleeved on the driving rod; and a sleeving portion being an annular wall and encompassing the driving rod; one end of the sleeving portion securely mounted on an outer edge of the plane portion.

9. The driving pump as claimed in claim 8, wherein:

the exhaust channel comprises:

a first exhaust section communicating with the first chamber;

a second exhaust section communicating with the first exhaust section and the oil reservoir; the exhaust blockage movably mounted in the second exhaust section; and an exhaust-abutting surface located between the first exhaust section and the second exhaust section and facing to the second exhaust section; and the main assembly further comprises:

an exhaust elastic component mounted in the second exhaust section and configured to push the exhaust blockage to abut the exhaust-abutting surface, and thereby isolating the first exhaust section and the second exhaust section.

10. The driving pump as claimed in claim 9, wherein:

the retract channel comprises:

a first retract section communicating with the oil chamber of the piston; the retract blockage movably mounted in the first retract section; and a second retract section communicating with the first retract section and the oil reservoir; and a retract-section-abutting surface located between the first retract section and the second retract section and facing to the first retract section; and the main assembly further comprises:

a retract elastic component mounted in the first retract section and configured to push the retract blockage to abut the retract-section-abutting surface, and thereby blocking the first retract section and the second retract section.

11. The driving pump as claimed in claim 1, wherein:

the main assembly further comprises:

a chamber-abutting surface located between the first chamber and the second chamber and facing to the first chamber;

the driving assembly further comprises:

a driving assembly elastic component sleeved on the driving rod;

two ends of the driving assembly elastic component respectively abutting the chamber-abutting surface and the stroke controlling component; and the power assembly comprises:

a cam abutting the first end of the driving rod such that the driving rod is moved during rotation of the cam.

12. The driving pump as claimed in claim 1, wherein:

the communicating passage comprises:

a first communicating section communicating with the first chamber; and a second communicating section communicating with the first communicating section and the second chamber;

a communicating-passage-abutting surface located between the first communicating section and the second communicating section and facing to the second communicating section; and the communicating blockage movably mounted in the second communicating section and selectively abutting the communicating-passage-abutting surface and thereby isolating the first communicating section and the second communicating section.

13. The driving pump as claimed in claim 12, wherein:

flow directions of the first communicating section and the second communicating section are parallel to an axial direction of the driving rod; and the communicating passage further comprises:

a radial communicating section; a flow direction of the radial communicating section parallel to a radial direction of the driving rod; the first communicating section communicating with the first chamber via the radial communicating section.

14. The driving pump as claimed in claim 12, wherein the driving assembly further comprises:

an elastic pin securely mounted in the second communicating section and protruding out of the second end of the driving rod.

15. The driving pump as claimed in claim 1, wherein the stroke controlling component comprises:

a plane portion being an annular plate and sleeved on the driving rod; and a sleeving portion being an annular wall and encompassing the driving rod; one end of the sleeving portion securely mounted on an outer edge of the plane portion.

16. The driving pump as claimed in claim 1, wherein:

the exhaust channel comprises:

a first exhaust section communicating with the first chamber;

a second exhaust section communicating with the first exhaust section and the oil reservoir; the exhaust blockage movably mounted in the second exhaust section; and an exhaust-abutting surface located between the first exhaust section and the second exhaust section and facing to the second exhaust section; and the main assembly further comprises:

an exhaust elastic component mounted in the second exhaust section and configured to push the exhaust blockage to abut the exhaust-abutting surface, and thereby isolating the first exhaust section and the second exhaust section.

17. The driving pump as claimed in claim 1, wherein the main assembly further comprises:

a retract channel; two ends of the retract channel respectively communicating with the oil chamber of the piston and the oil reservoir; and a retract blockage selectively blocking the retract channel.

18. The driving pump as claimed in claim 17, wherein:

the retract channel comprises:

a first retract section communicating with the oil chamber of the piston; the retract blockage movably mounted in the first retract section; and a second retract section communicating with the first retract section and the oil reservoir; and a retract-section-abutting surface located between the first retract section and the second retract section and facing to the first retract section; and the main assembly further comprises:

a retract elastic component mounted in the first retract section and configured to push the retract blockage to abut the retract-section-abutting surface, and thereby blocking the first retract section and the second retract section.

19. The driving pump as claimed in claim 18, wherein the main assembly further comprises:

a controlling component located in the second retract section, and selectively mounted through the retract-section-abutting surface to push the retract blockage to move, such that the first retract section and the second retract section communicate with each other.

20. A clamping tool comprising:

a housing;

the driving pump as claimed in claim 1 securely mounted in the housing;

a first clamping component securely mounted on the piston of the driving pump;

a second clamping component securely mounted on the housing; and a clamping distance defined between the first clamping component and the second clamping component and controlled by a position of the piston of the driving pump.

* * * * *